US007073893B2

(12) United States Patent
Takeuchi et al.

(10) Patent No.: US 7,073,893 B2
(45) Date of Patent: Jul. 11, 2006

(54) INKJET RECORDING HEAD

(75) Inventors: Yoshio Takeuchi, Hachioji (JP); Akihiko Tamura, Hachioji (JP); Katsuaki Komatsu, Hachioji (JP); Kazuo Asano, Hino (JP); Katuichi Kawabata, Yokohama (JP)

(73) Assignee: Konica Minolta Holdings Inc., Tokyo (JP)

( * ) Notice: Subject to any disclaimer, the term of this patent is extended or adjusted under 35 U.S.C. 154(b) by 251 days.

(21) Appl. No.: 10/723,619

(22) Filed: Nov. 25, 2003

(65) Prior Publication Data

US 2004/0104979 A1 Jun. 3, 2004

(30) Foreign Application Priority Data

Dec. 3, 2002 (JP) ..... 2002-351705

(51) Int. Cl.
*B41J 2/045* (2006.01)
*B41J 29/38* (2006.01)

(52) U.S. Cl. ..... 347/68; 347/12

(58) Field of Classification Search ..... 347/12, 347/47, 68, 69, 70, 94, 128; 400/124; 29/25.35; 310/342, 311

See application file for complete search history.

(56) References Cited

U.S. PATENT DOCUMENTS 4,887,100 A * 12/1989 Michaelis et al. ..... 347/69
5,016,028 A * 5/1991 Temple ..... 347/69

FOREIGN PATENT DOCUMENTS

JP 02-150355 6/1990

* cited by examiner

*Primary Examiner*—Lamson Nguyen
*Assistant Examiner*—Jannelle M. Lebron
(74) *Attorney, Agent, or Firm*—Frishauf, Holtz, Goodman & Chick, P.C.

(57) ABSTRACT

An inkjet recording head for ejecting ink, having a plurality of piezoelectric sidewalls to form a plurality of ink channels; a piezoelectric bottom plate; and a plurality of electrodes All of the ink channels are divided into two or more groups of ink channels composed of ink channels between which at least one ink channel is sandwiched;

wherein an ink ejection operation is performed successively in a time-sharing mode for each of the group of ink channels, while satisfying the condition of $|CTC+CTE| \leqq 10$ (%); where a crosstalk between ink channels in one group due to a compliance ratio of the sidewalls to the ink in the ink channel is CTC; and a crosstalk between ink channels in one group due to a leak of electric field caused by electric voltage applied to the electrodes is CTE.

16 Claims, 6 Drawing Sheets

FIG. 2 ( a )
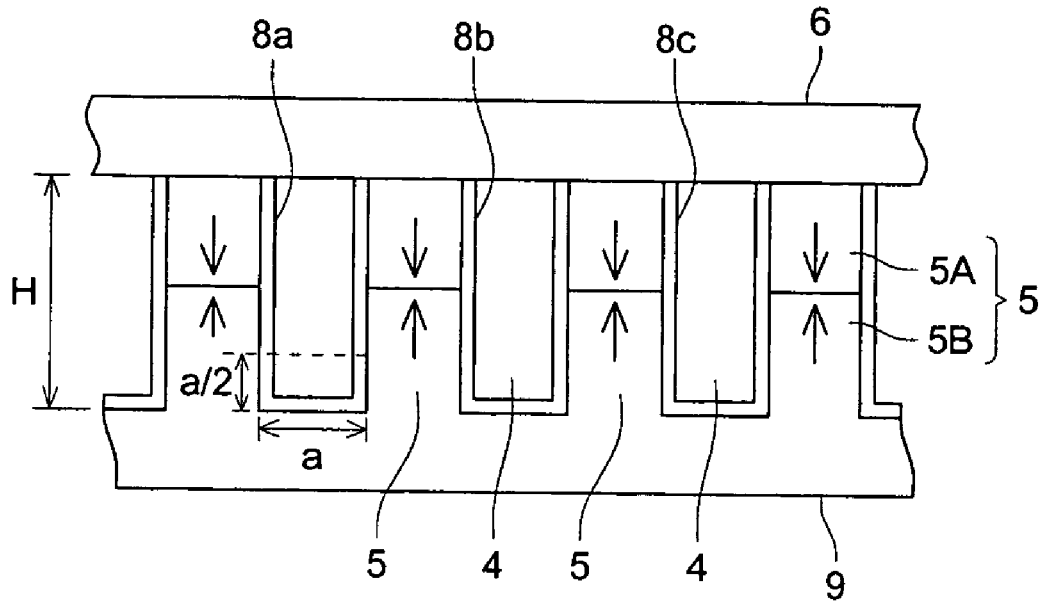
FIG. 2 ( b )
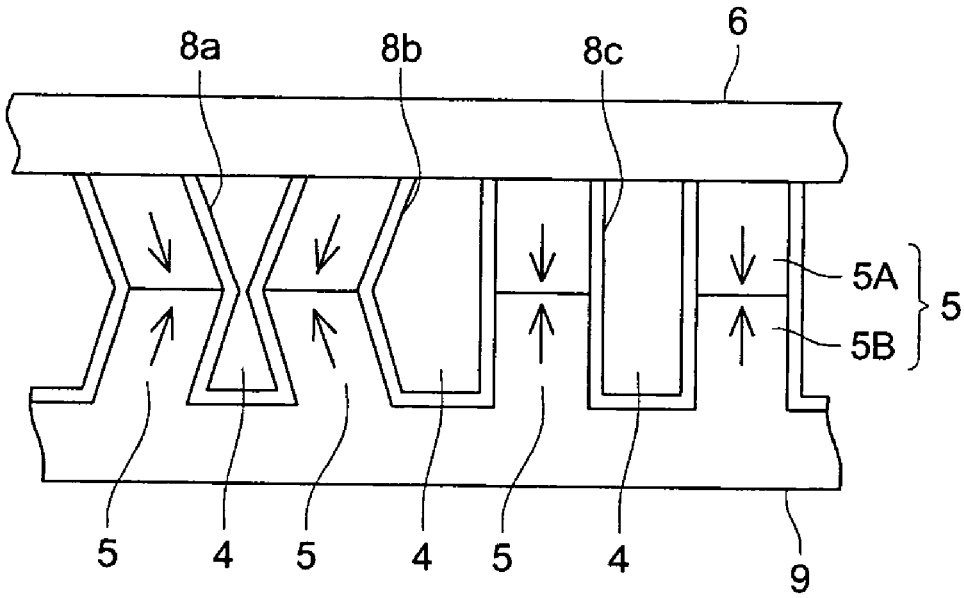

FIG. 3 ( a )
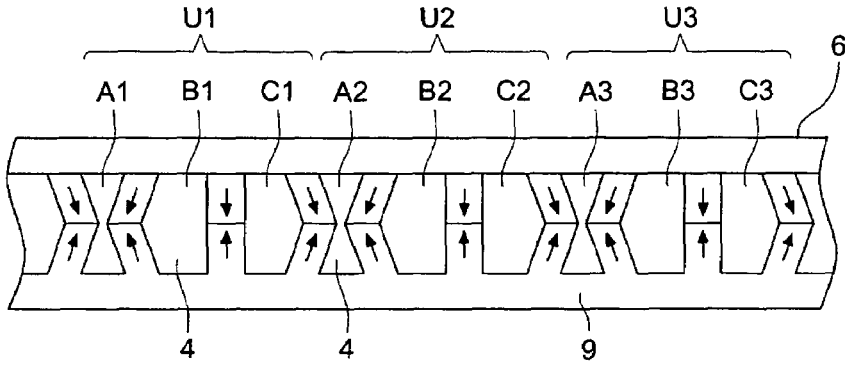
FIG. 3 ( b )
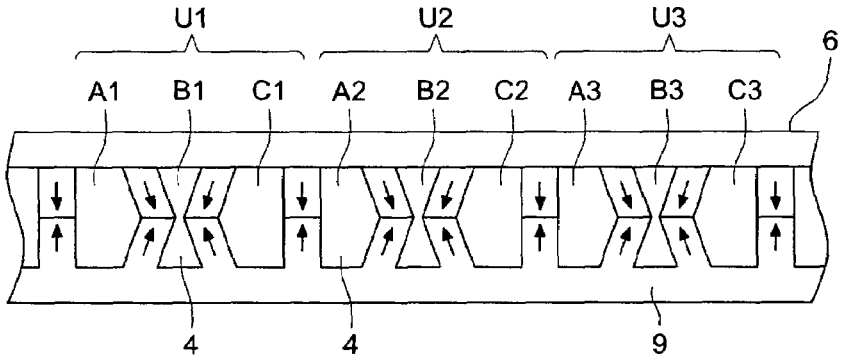
FIG. 3 ( c )
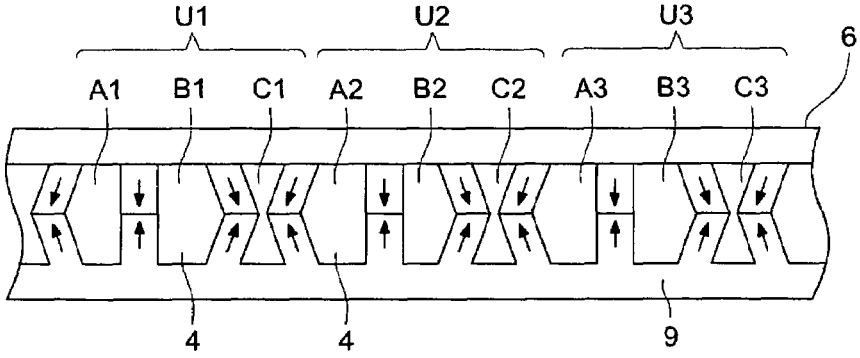

INKJET RECORDING HEAD

BACKGROUND OF THE INVENTION

The present invention relates to an inkjet recording head, and particularly to an inkjet recording head capable of high speed and stable drive by compensating variation of ink ejection speed from each channel due to crosstalk generated at the time of drive.

Conventional Technology

Various methods have been proposed for an inkjet recording head, and one of these is an inkjet recording head of a shear mode (Patent Literature 1).

FIGS. 1 and 2(*a*), (*b*) are drawings to show an example of this inkjet recording head. FIG. 2(*a*), (*b*) are partial cross-sectional views taken on line Z—Z in FIG. 1. Number 1 is an ink tube, 2 is a nozzle forming member, 3 is a nozzle, 4 is an ink channel, 5 is a sidewall, 6 is a cover plate, 7 is an ink supply opening, 8 is an electrode and 9 is a substrate. As can be seen from FIG. 1 and FIG. 2(*a*), ink channels 4 are constituted by sidewalls 5, cover plate 6 and substrate 9, and the ink channels 4 have a flat bottom portion and a curved bottom portion. The shape of this inkjet recording head is an example of a preferred embodiment, and is not restricted to the shape shown in FIG. 1.

Many ink channels 4 which are separated by a plurality of sidewalls 5 are constituted between cover plate 6 and substrate 9, as shown in a cross-sectional view of FIG. 2. In FIG. 2, only three of a plurality of ink channels 4 are shown. One end of ink channel 4 is connected to nozzle 3 which is formed in nozzle forming member 2, and ink channel 4 is connected to an ink tank, which is not shown in the drawing, by ink tube 1 via ink supply opening 7. Further, electrodes 8*a*, 8*b* and 8*c*, which extend from the upper portion of both sidewalls 5 to the bottom face of substrate 9, are adhered on sidewall 5 in each ink channel 4. Each of the electrodes 8*a*, 8*b* and 8*c* connects the respective electrodes, opposing each other and facing the inside of ink channels 4, in common as shown in the drawing, and an ink drop is ejected according to the following movement when a printing pulse is applied on said electrodes opposing each other.

Sidewall 5 is constituted of sidewalls 5A and 5B comprising two piezoelectric substances having different polarization directions, sandwiching an adhesive portion, as shown by arrows in FIG. 2(*a*). Sidewalls 5A and 5B do not deform when a printing pulse is not applied on any of electrodes 8*a*, 8*b* and 8*c*, while generated is an electric field in the perpendicular direction to the polarization direction of a piezoelectric substance, resulting in causing shear deformation at an adhesive face between sidewalls 5A and 5B, when a printing pulse is applied on electrode 8*a* as shown in FIG. 2(*b*) and electrodes 8*b* and 8*c* are simultaneously grounded, thereby pressure of ink is changed to eject a part of ink filling ink channel 4 from nozzle 3. Herein, the direction of deformation of a sidewall can be changed by changing the polarity of a printing pulse and the direction of electric field thereby. Hereinafter, the movement of applying a pulse to electrodes opposing each other, which are connected together to face the inside of ink channel 4, is expressed as "to apply a pulse to a channel". In FIG. 2(*a*), (*b*), a nozzle is not shown.

Driving this inkjet recording head of a multi-channeled shear mode is generally performed by dividing ink channels 4 into 3 groups to be driven in turn in a time-sharing mode. Hereinafter, in this description, this time-sharing may be referred to as "period" and the time-sharing of an ink channel divided into n parts as "n-period". In the embodiment shown in FIG. 3, an inkjet head will be explained as the ink channels are constituted of 9 channels of A1, B1, C1, A2, B2, C2, A3, B3 and C3. Further, the time chart of printing pulses is shown in FIG. 4. In FIG. 4, a pulse wave shape applied to each ink channel is expressed vertically and each period (time) horizontally, however, scales of such as time and pulse voltage is not always expressed correctly.

As shown in FIG. 3(*a*), when printing pulse Pa (shown in FIG. 4) is applied to drive A group, three channels A1, A2 and A3 simultaneously, at the first period T1*a*, sidewalls of these three channels A1, A2 and A3 are deformed simultaneously resulting in ejection of ink drops from each nozzle. In a similar manner, as shown in FIGS. 3(*b*) and 3(*c*), when printing pulse Pb (shown in FIG. 4) is applied to drive B group, three channels B1, B2 and B3 simultaneously, at the second period T1*b*, and printing pulse Pc (shown in FIG. 4) is applied to drive C group, three channels C1, C2 and C3 simultaneously, at the third period T1*c*, each sidewall is deformed successively to drive all of 9 channels by circulating a sequence of three periods, T1*a*, T1*b* and T1*c*, ejection of ink drops from each nozzle results.

It is clear from FIGS. 3 and 4 that 9 ink channels are divided according to the arrangement order into units U1, U2 and U3, each of which contains three ink channels comprising each one ink channel belonging to A group, B group and C group, and are driven at a drive cycle comprised of periods T1*a*, T1*b* and T1*c*. Images are formed by repeating this drive cycle. In the embodiment of FIGS. 3 and 4, three ink channels constitute one unit, however, n ($n \geqq 2$) ink channels generally constitute one unit and applied is a driving method in which n periods constitute one drive cycle.

Naturally, in the aforementioned driving method, a printing pulse is not necessarily applied to all ink channels as described above and some ink channels are not driven depending on image signals when images are practically formed.

<Patent Literature 1>

Japanese Patent Publication Open to Public Inspection No. 2-150355

Problems to be Solved

As explained above, it has been proved that when driven at 3 periods is a shear mode inkjet recording head, in which many sets of a plurality of ink channels are arranged, sidewall 5 is deformed to transmit a part of the pressure and to affect other ink channels resulting in crosstalk between a driven ink channel and other ink channels, which in turn results in varying ejection speed of ink drops to cause undesirable effects on image quality.

As described above, three channels of A1, A2 and A3 belonging to A group are driven simultaneously at first period T1*a*. In this case, due to symmetrical effect, the pressure variation in ink channels B1, C1, B2, C2, . . . is half value with opposite sign (positive or negative) to the pressure variation in ink channels A1, A2, . . . . On the other hand, in the case where ink channel A2 is singularly driven, the pressure variation extends farther to C1, B1, A1, B1, C2, A2, . . . . As the result, the pressure generated in A2 is greater in the case where A1, A2, and A3 are simultaneously driven than in the case where A2 is singularly driven. Thereby ink channel A2, when simultaneously driven, ejects ink drops at a higher speed resulting in variation of size and shape of ink drops.

This phenomenon is also observed with ink channels A1 and A3, by getting effects mutually from ink channel A0 which is located at the left side of ink channel A1, and ink channel A4 which is located at the right side of ink channel A3, although they are abbreviated in the drawing, resulting in so-called crosstalk, and ink drops are ejected at a high speed from all the ink channels belonging to A group except ink channels at the both end when all the ink channels in A group are driven in this way. However, as shown in FIG. 5, when only ink channel A2 is driven, ink ejected from ink channel A2 shows slower speed than that when ink channels A2 is driven simultaneously with A1, A3, . . . , which may cause the volume change of ink drops resulting in undesirable problems in image formation. In practice, the effects of crosstalk, which individual ink channels receive, differs depending on image signal patterns, and speed and volume of ink drops ejected from nozzles differ depending on individual states.

Further, the range of ink channels in which this crosstalk is caused depends on rigidity of a material comprising ink channels, however, generally crosstalk transmits as far as the range of several channels. Therefore, the spacing between ink channels which drive simultaneously may be extended and a number of driving period is increased, for example, to drive at 6 periods may be preferred, however, there causes problems of such as prolonged total image forming time.

This invention is presented to solve the problem of the effects on other channels by crosstalk caused at the time of driving, and the objective is to provide an inkjet recording head in which variation of the ejection speed from each ink channel due to crosstalk is compensated, and capable of high speed and stable driving as well as highly visible image formation.

SUMMARY OF THE INVENTION

The inventors have found, as a result of extensive study on the causes of crosstalk, that the following two causes are predominating with crosstalk and the effects of the crosstalk for the variation of the ejection speed are mutually in opposite directions. That is, crosstalk can be decreased by regulating the difference between these crosstalk into a predetermined range, or by canceling them each other, and thereby this invention has been realized.

There are two kinds of crosstalk regarding with this invention.

(i) Crosstalk between ink channels in one group caused by a compliance ratio of a sidewall to ink in an ink channel (described as CTC hereinafter).

(ii) Crosstalk between ink channels in one group caused by a leak of electric field generated with electric voltage applied to the electrode (described as CTE hereinafter).

The above-described problems can be solved by the following features of this invention.

(1) An inkjet recording head provided with a plurality of ink channels which are separated by sidewalls at least partially comprised of piezoelectric substance, the bottom face of the ink channels being formed with a piezoelectric material, and eject ink in ink channels by changing pressure in ink channels by shear deformation of the sidewall caused by electric voltage applied on electrodes formed on sidewalls, characterized in that all ink channels are divided into two or more groups by making ink channels, between which sandwiching one or more ink channels, into one group, and an ink ejection movement is performed successively in a time-sharing mode for each group, as well as the condition of $|CTC+CTE| \leqq 10(\%)$ is satisfied, wherein crosstalk between ink channels in above-described one group due to a compliance ratio of a sidewall to ink in an ink channel is CTC, and crosstalk between ink channels in above-described one group due to a leak of electric field caused by electric voltage applied to the above-described electrode is CTE.

(2) The inkjet recording head described in item 1 characterized in that said sidewalls are formed by accumulating piezoelectric substances, which are polarized in the thickness direction, sandwich an adhesive portion (contact face) and makes their polarization directions different with each other.

(3) The inkjet recording head described in item 1 or 2 characterized in that said electrode is present in a range of at least a/2 high from the bottom face of said ink channel, wherein a flow path width of said ink channel is a.

(4) The inkjet recording head described in item 1, 2 or 3 characterized by said electrode being formed by means of a plating method.

(5) The inkjet recording head described in any one of items 1–4 characterized by said ink channel width (flow path width of said ink channel) being less than 100 μm and ink channel height being less than 300 μm.

(6) The inkjet recording head described in any one of items 1–5 characterized in that said ink channels are constituted of a substrate, on which a plurality of grooves, which are separated by sidewalls and at least partly comprised of a piezoelectric substance are formed, and a cover plate adhered to the top face of the sidewalls, and the thickness of the piezoelectric substance at the bottom face of said ink channel is at least 10 μm.

(7) The inkjet recording head described in any one of items 1–6 characterized by the density of said plurality of ink channels being at least 150 dpi.

(8) The inkjet recording head described in any one of items1–6 characterized by the density of said plurality of ink channels being at least 300 dpi.

(9) The inkjet recording head described in any one of items 1–8 characterized by that the density of said plurality of ink channels (dpi) and the depth of said plurality of ink channels (μm) satisfy the following relation:

$$\text{the density (dpi)} \times \text{the depth } (\mu m) \leqq 5.5 \times 10^4$$

(10) The inkjet recording head described in any one of items 1–7 characterized by said ink being water-based ink.

(11) The inkjet recording head described in any one of items 1–10 characterized in that all ink channels are divided into three groups by making ink channels, which are distant and sandwich two ink channels among the above-described plurality of ink channels, into one group, and ink ejection movement is performed successively in a time-shearing mode for each group.

Effect of the Invention

This invention can provide an inkjet recording head which solves problems of the effects on other channels caused by crosstalk at the time of driving and compensates variation of ink ejection speed from each ink channel caused by crosstalk, resulting in high speed and stable drive as well as highly visible image formation.

BRIEF DESCRIPTION OF THE DRAWINGS

FIGS. 2(*a*) and (*b*) are drawings to show basic movement of an inkjet recording head.

FIGS. 3(*a*), (*b*) and (*c*) are drawings to show the state of an inkjet recording head being driven in a time-shearing mode.

DETAILED DESCRIPTION OF THE PREFERRED EMBODIMENT

Figure 1:
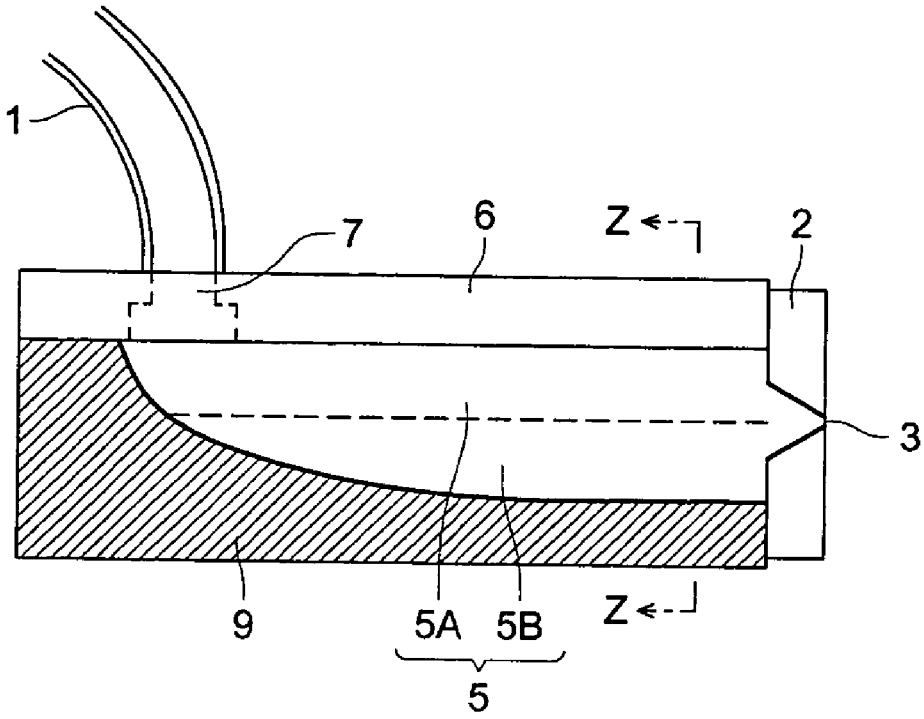
FIG. 1 is a cross-sectional drawing to show an exemplary constitution of an inkjet recording head.
Figure 4:
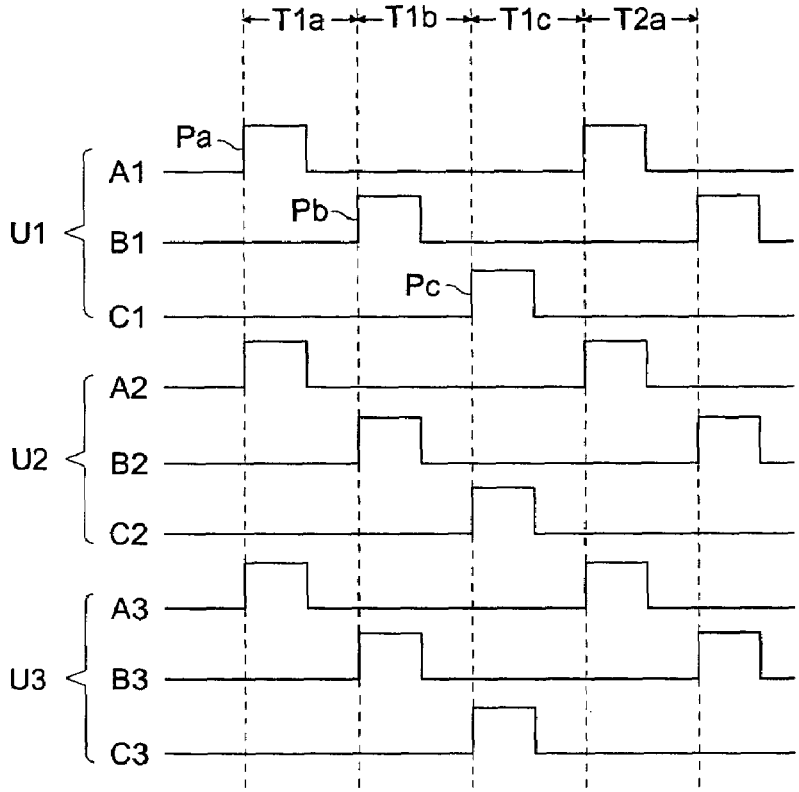
FIG. 4 is a time chart of a printing pulse.

An inkjet recording head according to this invention is characterized in that a plurality of ink channels, which are separated by sidewalls at least partially comprised of piezoelectric substance, and whose bottom faces are formed of piezoelectric substance are provided; ink in ink channels is ejected by changing the pressure in ink channels by shear deformation of a sidewall caused by electric voltage applied on an electrode formed on a sidewall; all ink channels are divided into two or more groups by making ink channels, between which sandwiching one or more ink channels, into one group to perform ink ejection movement successively in a time-sharing mode for each group; as well as the following condition is satisfied wherein crosstalk between ink channels in above-described one group due to a compliance ratio of said sidewall to ink in an ink channel is CTC, and crosstalk between ink channels in above-described one group due to leak of electric field caused by electric voltage applied to above-described electrode is CTE.

$$|CTC+CTE| \leqq 10(\%)$$

Herein, above-described CTC, that is crosstalk between ink channels in one group due to a compliance ratio of a sidewall to ink in an ink channel, will be firstly detailed.

As described above, three channels of A1, A2 and A3 belonging to A group are driven simultaneously at first period T1*a*. In this case, due to symmetrical effect, the pressure variation in ink channels B1, C1, B2, C2, . . . is half value with opposite sign (positive or negative) to the pressure variation in ink channels A1, A2, . . . . On the other hand, in the case where ink channel A2 is singularly driven, the pressure variation extends farther to C1, B1, A1, B1, C2, A2, . . . . As the result, the pressure generated in A2 is greater in the case where A1, A2, and A3 are simultaneously driven than in the case where A2 is singularly driven. Thereby ink channel A2, when simultaneously driven, ejects ink drops at a higher speed resulting in variation of size and shape of ink drops.

This phenomenon is also observed with ink channels A1 and A3, by getting effects mutually from ink channel A0 which is located at the left side of ink channel A1, and ink channel A4 which is located at the right side of ink channel A3, although which are abbreviated in the drawing, to cause so-called crosstalk, and ink drops are ejected at a high speed from all the ink channels belonging to A group except ink channels at the both end when all the ink channels in A group are driven in this manner. However, as shown in FIG. 5, when only ink channel A2 is driven, ink ejected from ink channel A2 shows slower speed than that when ink channels A2 is driven simultaneously with A1, A3, . . . .

While, with respect to above-described CTE, that is crosstalk between ink channels in one group due to a leak of electric field caused by electric voltage being applied to the electrode, when a sidewall is constituted of two piezoelectric substances having different polarization directions, a leak of electric field is generated due to electric voltage applied on the electrode in the case of the bottom face being piezoelectric substance because an electrode is present as far as the bottom face of an ink channel.

Figure 5:
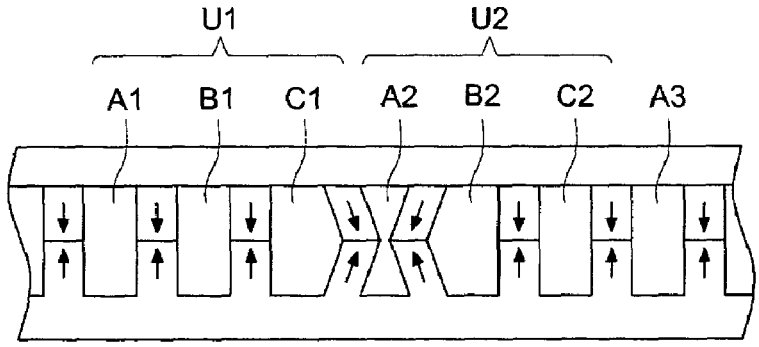
FIG. 5 is a drawing to show the state of only one ink channel in an inkjet recording head being driven.

For example as shown in FIG. 5, in case of only ink channel A2 being driven, since a part of electric field due to electric voltage applied at the time of the drive leaks from electrodes of each sidewall of ink channel A2, resulting in a little deformation of the bottom face of ink channel A2 comprised of a piezoelectric substance, toward the inside of ink channel A2, and the ink ejection speed from this ink channel A2 becomes faster. However, as shown in FIG. 3(*a*), in case of three ink channels of A1, A2 and A3 being simultaneously driven, a part of electric field applied to ink channels A1 and A3 leaks toward ink channel A2 side through the bottom comprised of a piezoelectric substance. At this time, a leak of electric field from ink channel A2 itself is also generated, however, because the effect of a leak of electric field from ink channel A2 itself is relaxed by the effect of leaks of electric field from ink channels A1 and A3, the ink ejection speed from ink channel A2 becomes slower.

In this manner, CTC increases the speed in case of driving all ink channels compared to that in case of driving one ink channel alone, while CTE decreases the speed in case of driving all ink channels compared to that in case of driving one ink channel alone, resulting in opposite effects on speed of ink drops to each other. Therefore, when CTC and CTE satisfy the above-described condition, crosstalk is decreased by each canceling effect and variation of ink ejection speed caused by this crosstalk can be compensated, so that high speed and stable drive becomes possible, resulting in an inkjet recording head capable of highly visible image formation. When a value of |CTC+CTE | is over 10%, it becomes difficult to utilize canceling effect. It is more preferable to make $|CTC+CTE| \leqq 8\%$.

Next, measurement methods and definitions of CTC and CTE will be explained. In the above-described example, the following relation exists, wherein a speed of an ink drop from ink channel A2 in case of all ink channels being driven is V1 and a speed of an ink drop from ink channel A2 in case of only ink channel A2 being driven is V2:

$$CTC+CTE=((V1-V2)/V2)\times 100 \text{ (unit is based on \%)}$$

Since CTC and CTE coexist in this equation, CTE is measured by means of another method. In a head shown in FIG. 3, a recording head is prepared in which ink supply openings of ink channels other than those in A group, that is those in B and C groups, are closed not to supply ink to ink channels of B and C groups (hereinafter, referred to as a dummy channel head), then closstalk is determined when a speed of an ink drop from ink channel A2 in case of all ink channels in A group being driven is V3 and a speed of an ink drop from ink channel A2 in case of only ink channel A2 being driven is V4.

$$CTE=((V3-V4)/V4)\times 100 \text{ (unit is based on \%)}$$

Since this value is closstalk in the state of ink channels of B and C groups being filled with air (compressive), CTC can be neglected. That is, this value is closstalk by the effect of CTE. Therefore, CTC can be determined by getting a difference from above-described CTC+CTE as follows.

$$CTC=(CTC+CTE)-CTE \text{ (unit is based on \%)}$$

CTC depends on rigidity of a material constituting an ink channel, and can be adjusted by changing the value of a compliance ratio of a sidewall to ink in an ink channel. The smaller becomes a compliance ratio, the smaller is CTC.

Herein, a compliance ratio is defined as follows. That is, when the pressure difference between the both surfaces of a sidewall is P and average displacement amount of a sidewall is δp, a total displacement amount is the product thereof with depth of ink channel H (refer to FIG. 2(*a*)), δp·H. While, volume change of ink in an ink channel is S·P/B when internal pressure in an ink channel P is raised. Herein, S is the cross-sectional area of an ink channel and B is the bulk modulus of elasticity of ink (wherein, the length of an ink channel is unit). Therefore, the ratio of a compliance of a sidewall to that of ink in an ink channel, kcr, is expressed by the following equation.

$$kcr=(\delta p\cdot H)/(S\cdot P/B)=(\delta p\cdot H\cdot B)/(S\cdot P)$$

A compliance ratio can be measured in the following manner. A resonance frequency in an ink channel when electric voltage is applied on a sidewall, fn, (in a state without a nozzle being attached) can be obtained by the following equation when a length of an ink channel is L and a sonic speed in ink is Co.

$$fn=Co/(2L(1+\lambda kcr)^{0.5})$$

Herein, λ is an intrinsic value of a vibration mode depending on the selection of ink channels on which electric voltage is applied, and it is 4 when voltage is applied every other channel, 3 when voltage is applied every third channel. Further, by changing the voltage pattern the vibration mode can be generated corresponding to the intrinsic value of 2 or 1. Therefore, a resonance frequency is determined by applying voltage in the above described various drive patterns and measuring electric current change at a resonance point by frequency scanning. From these measured data, kcr can be obtained since a slope becomes $kcr\cdot(2L/Co)^2$ in a graph in which plotted are λ as abscissa and $1/fn^2$ as ordinate.

Next, a constitution of an inkjet recording head according to this invention will be explained. In this invention, a piezoelectric substance at least partially constituting the sidewalls is not limited provided that deformation is generated by voltage application and commonly known substances are utilized. They may be organic materials, however, preferable are piezoelectric non-metallic materials, and the latter includes, for example, ceramic substrates formed through processes such as molding and baking, or substrates formed without molding and baking. Organic materials include organic polymers, and hybrid materials comprising an organic polymer and an inorganic substance.

Ceramic substrates include PZT ($PbZrO_3$—$PbTiO_3$) and PZT added with the third component, which is, for example, $Pb(Mg_{1/3}Nb_{2/3})O_3$, $Pb(Mn_{1/3}Sb_{2/3})O_3$ or $Pb(Co_{1/3}Nb_{2/3})O_3$, and further can be formed by utilizing $BaTiO_3$, ZnO, $LiNbO_3$ and $LiTaO_3$.

Further, substrates formed without subjecting to molding and baking processes, for example, can be formed by means of such as a sol-gel method and accumulated substrate coating. According to a sol-gel method, a sol is prepared by addition of water, acid or alkali into a homogeneous solution having a predetermined chemical composition to cause chemical change such as hydrolysis. Further, a sol, in which precursors of fine particles having an aimed composition or of non-metallic inorganic fine particles are dispersed can be prepared by addition of a process such as solvent evaporation or cooling, and can be converted to a substrate. In a sol-gel method, a compound having a homogeneous chemical composition can be obtained including addition of a tiny amount of different kinds of elements, and as starting materials generally utilized are water-soluble metal salts or metal alkoxides such as sodium silicate, wherein metal alkoxides are compounds represented by general formula $M(OR)_n$, which have strong basic characteristic due to OH group, can be easily hydrolyzed to be converted into metal oxides or hydrates compounds thereof via a condensation process similar to that of an organic polymer.

There is a method, called as accumulated substrate coating, in which materials are vacuum evaporated from a gas phase, and the methods of preparing a ceramic substrate from a gas phase are classified into two methods, an evaporation method by a physical means and a manufacturing method utilizing a chemical reaction on the surface of a substrate; further a physical evaporation method (PVD) is subdivided into such as a vacuum evaporation method, a sputtering method and an ion plating method, and a chemical method includes such as a gas phase chemical reaction method (CVD) and a plasma CVD method. In a vacuum evaporation method as a physical evaporation method (PVD), an object substance is heated to be evaporated in vacuo, and the vapor is adhered on a substrate; and in a sputtering method, utilized is a sputtering phenomenon in which high-energy particles are collided onto an object substance (a target) to expel atoms or molecules out of the target surface by exchanging momentum between atoms or molecules at the target surface and colliding particles. While, in an ion plating method, evaporation is performed in an environment of ionized gas. Further, in a CVD method, atoms, molecules or ions to constitute film are introduced to a reaction part with a suitable carrier gas after having been made into a gas state, and are reacted or reacted to be precipitated on a heated substrate to form film; and in plasma CVD method, a gaseous state is generated by plasma energy and film is precipitated by a gas phase chemical reaction in a relatively low temperature range of 400–500° C.

There are a case in which substrate 9 is also made of a piezoelectric substance and a case in which substrate 9 is made of a non-piezoelectric substance, to constitute a plurality of ink channels 4, as shown in a cross-sectional drawing of FIG. 2(*a*), which are separated by a plurality of sidewalls 5 between cover plate 6 and substrate 9 by use of such as a piezoelectric substance.

Figure 6:
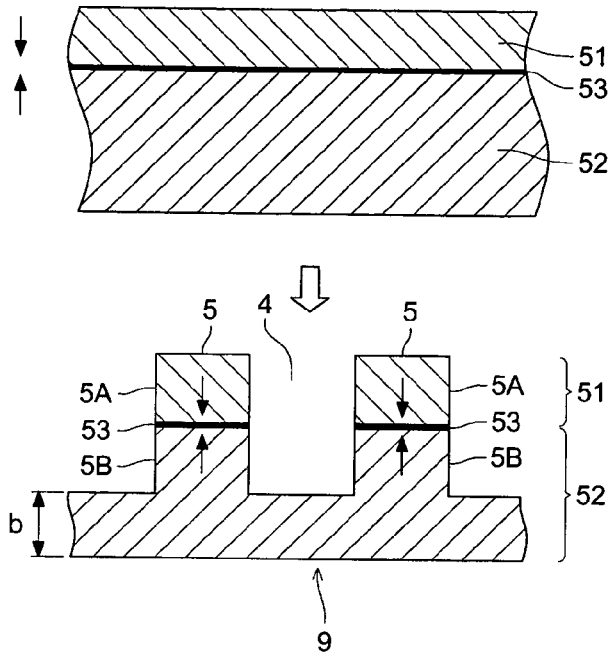
FIG. 6 is a drawing to show an exemplary case of manufacturing sidewalls comprised of 2 sheets of piezoelectric substances.

In the former example, as shown in FIG. 6, each of two sheets of piezoelectric substances 51 and 52 is adhered sandwiching adhesive portion 53 so as to arrange the polarization direction different with each other after being polarized in the thickness direction, and a plurality of parallel grooves which cross over from the upper portion of piezoelectric substance 51 to the intermediate potion of piezoelectric substance 52 are cut by use of such as a diamond blade, resulting in simultaneous formation of sidewalls 5 comprising sidewalls 5A and 5B which are polarized in the directions of arrows, and substrate 9.

Figure 7:
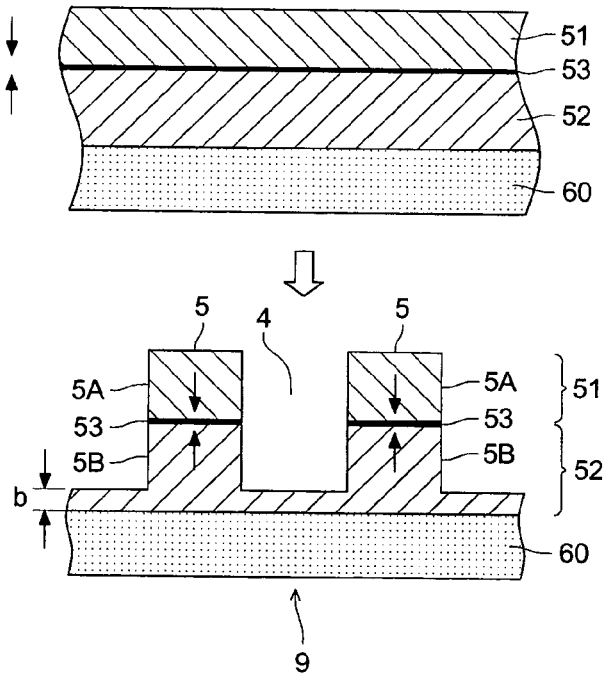
FIG. 7 is a drawing to show another exemplary case of manufacturing sidewalls comprised of 2 sheets of piezoelectric substances.

While, in the latter example, as shown in FIG. 7, each of two sheets of piezoelectric substances 51 and 52 is adhered sandwiching adhesive portion 53 so as to arrange the polarized direction different with each other after being polarized in the thickness direction, further non-piezoelectric substance 60 which functions as a substrate is adhered to the back face of piezoelectric substance 52, and a plurality of parallel grooves starting from the upper portion of piezoelectric substance 51 are cut by use of such as a diamond blade, resulting in formation of sidewalls 5 comprising sidewalls 5A and 5B which are polarized in the directions of arrows.

In either of the cases described above, a bottom face of each ink channel 4 is constituted of a piezoelectric substance, and thickness of a bottom face of each ink channel 4 is preferably at least 10 μm. CTE is negligibly small when the thickness is less than 10 μm, while CTE can be generated when the thickness is at least 10 μm resulting in that CTC can be easily canceled.

To make the thickness of a bottom face of ink channel 4 to be at least 10 μm, in the former example shown in FIG. 6, it is possible to adjust the thickness of piezoelectric substance 52 being left by said cutting process to be at least 10 μm at the time of cutting process that reaches to the intermediate part of piezoelectric substance 52. Further, in the latter example shown in FIG. 7, it is possible to make the thickness of a piezoelectric substance 52 at a bottom face of ink channel 4 to be at least 10 μm, by adjusting the depth to leave a part of piezoelectric substance 52 and the amount to be left, also at the time of cutting process of grooves.

A plurality of ink channels 4 can be formed by providing cover plate 6 on the top surface of sidewalls 5 thus prepared. These ink channels 4 are preferably formed to have not greater than 100 μm width and not greater than 300 μm depth, and a cross-sectional area of each ink channel 4 becomes small by having such width and height, resulting in an improved removability of air bubbles in ink and constant formation of high quality images.

Cover plate 6 is adhered to the top face of sidewalls 5 via an adhesive so as to cover the upper surface throughout all the ink channels 4. A material of cover plate 6 is not specifically limited and may be a substrate comprised of an organic material, however, preferably a substrate comprised of a non-piezoelectric non-metallic material. This substrate comprised of a non-piezoelectric non-metallic material is preferably at least one selected from alumina, aluminum nitride, zirconia, silicon, silicon nitride, silicon carbide, quartz and PZT. This non-piezoelectric material substrate is, for example, a ceramic substrate formed through processes such as molding and baking, or a substrate formed without molding and baking processes. As ceramic substrates formed via such processes as baking, utilized can be, for example, such as $Al_2O_3$, $SiO_2$, mixtures or melted mixtures thereof, $ZrO_2$, BeO, AlN and SiC. Organic materials include organic polymers, and hybrid materials of an organic polymer and an inorganic substance.

Nozzle forming member 2 in which nozzle 3 is opened is adhered via an adhesive onto the front-end surfaces of substrate 9 and sidewalls 5 on which cover plate 6 is adhered. As a material of nozzle forming member 2, utilized can be metal materials such as stainless steel in addition to synthetic polymers such as polyimide resin, polyethylene terephthalate resin, liquid crystal polymer, aromatic polyamide resin, polyethylene naphthalate resin and polysulfon resin.

For electrodes 8*a*, 8*b* and 8*c* formed and adhered on sidewall 5 in each of ink channels 4, utilized can be platinum, gold, silver, copper, aluminum, palladium, nickel, tantalum and titanium, and specifically preferably gold, aluminum, copper and nickel, with respect to electric characteristics and manufacturing suitability.

These electrodes 8*a*, 8*b* and 8*c*, as shown in FIG. 2(*a*), preferably exist on the side surface of sidewalls at least over the height range of "a/2" from the bottom face of ink channel 4, wherein a flow path width of said ink channel 4 is "a", with respect to exhibiting the effects of this invention more significantly.

As for a method to form electrodes 8*a*, 8*b* and 8*c*, utilized can be such as a plating method, an evaporation method and a sputtering method, and among them a plating method is preferred. Since an electrode formed by means of a plating method becomes harder than that formed by means of other methods, the aforementioned compliance ratio can be decreased, which is effective for the purpose of decreasing CTC.

Ink-supplying opening 7 is opened on the top face of cover plate 6, and ink tube 1 is connected to this ink-supplying opening 7. Ink is supplied to each ink channel 4 via ink tube 1 from an ink tank which is not shown in the drawing.

In an inkjet recording head according to this invention, it is preferable to utilize specifically water-based ink as ink to exhibit the effect of this invention significantly. This is because water-based ink has generally a large bulk modulus of elasticity, thereby the aforementioned compliance tends to become large resulting in a large effect of CTC. Herein, water-based ink is defined as ink having at least 50 weight % of a water content based on the total ink weight.

In an inkjet recording head according to this invention, a plurality of ink channels, ink channels among which being distant by sandwiching at least one ink channel are united into one group, are divided into at least two groups and driven to perform ink ejection operation successively in a time-sharing mode. Specifically, as shown in FIG. 3(*a*), preferable embodiment is to unite ink channels A1, A2 and A3 (ink channels B1, B2 and B3 or ink channels C1, C2 and C3), which are distant by sandwiching 2 ink channels between them, into one group, to divide the all ink channels into three groups (A, B and C groups), and to perform an ink ejection operation by each group successively in a time-sharing mode, because the effects of this invention are most significant due to a decreased distance between driven ink channels to show a tendency of increased effects of crosstalk.

The range of ink channels in which crosstalk transmits generally covers several channels, and to increase the distance between ink channels which move at the same time and increase the driving cycles result in decreasing effects of crosstalk, while to decrease the cycles results in increasing effects of crosstalk. Therefore, to decrease the cycles increase the effects of this invention, however, crosstalk becomes too large to be canceled at two cycles (every two adjacent ink channels are driven), and the effects of this invention is significant at three cycles (every three adjacent ink channels are driven).

Further, effects of crosstalk become large due to decreased distance between ink channels 4 when the density of ink channels 4 is at least 150 dpi, resulting in significant effects of this invention being exhibited.

Further, effects of crosstalk become larger due to further decreased distance between ink channels 4 when the density of ink channels 4 is at least 300 dpi, resulting in more significant effects of this invention being exhibited.

Further, it is preferable for effectively canceling the crosstalk to make the depth of ink channels smaller in the case where the density of ink channels 4 becomes higher. In this case the density of ink channels (dpi) and the depth of ink channels (μm) are preferable to satisfy the following relation:

$$\text{the density (dpi)} \times \text{the depth } (\mu m) \leqq 5.5 \times 10^4$$

In cases where the above relation is not satisfied, CTC becomes very large, and the effect of canceling the crosstalk decreases.

Incidentally, in the above explanation, each sidewall 5 is formed by accumulating piezoelectric substances polarized in the thickness direction to make the polarization direction different with each other sandwiching an adhesive portion, and electrodes 8*a*, 8*b*, 8*c*, etc. in each ink channel 4 are formed continuously covering from the top face of side wall 5 (at the side where cover plate 6 is adhered) to the bottom face of ink channel 4 (at the opposite side where cover plate 6 is adhered); in this case, the electrode is not necessarily continuous at the bottom face in ink channel 4, provided that it is located at least near the bottom of the side surface of sidewalls 5 and preferably covers the side surface over at least "a/2" height range from the bottom face of ink channels 4 with respect to flow path width, "a".

Figure 8:
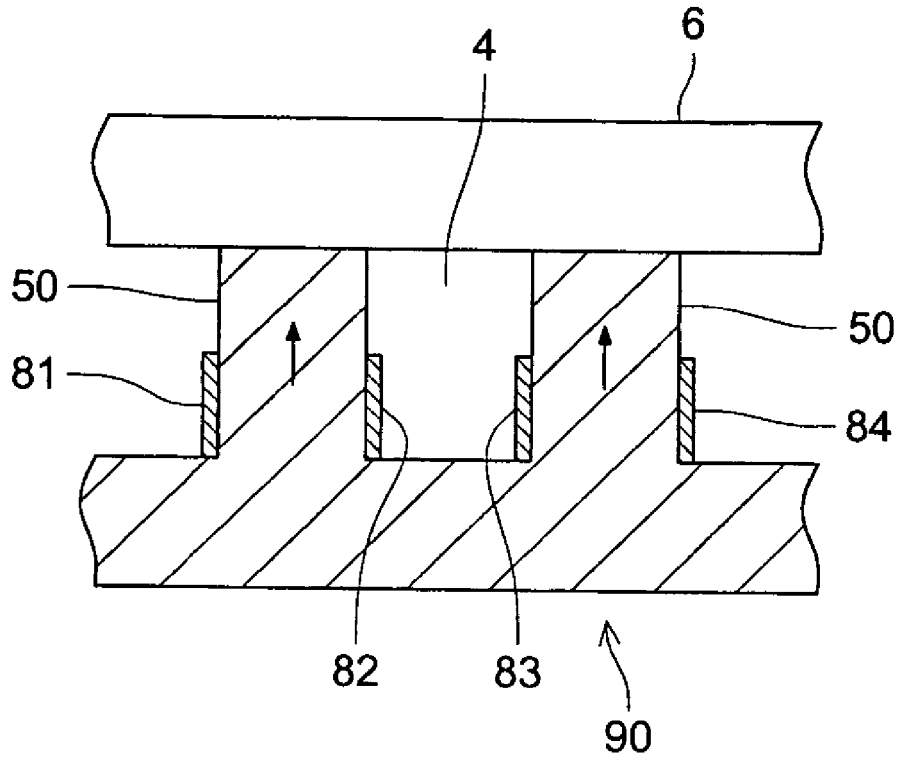
FIG. 8 is a cross-sectional drawing to show other examples of sidewalls and electrodes.

Further, in this invention, sidewalls 5 are not limited to those formed by accumulating piezoelectric substances, which are polarized in the thickness direction, to make the polarization directions to be different from each other. For example, sidewalls 50 are formed as shown in FIG. 8 by cutting a plurality of parallel grooves in substrate 90 comprising polarized only in one direction, and electrodes 81, 82, 83, etc., may be formed on the side surface of said sidewalls 50 so that they cover approximately up to the half height from the bottom of ink channels 4. In this case, the bottom in each ink channel 4 is comprised of a piezoelectric substance to generate leaks of electric field from each of electrodes 81, 82, 83, etc. which are provided adjacent to this piezoelectric substance.

EXAMPLES

In the following, the effects of this invention will be exemplified based on examples.

Examples 1–3, and Comparison 1

First, an inkjet recording head was prepared according to the following conditions. As shown in FIGS. 1 to 3, sidewalls were formed by cutting a plurality of grooves on a substrate comprising PZT, and aluminum evaporated electrode was formed on the side surface of each sidewall. A cover plate together with a nozzle forming member the front end of which a nozzle of 25 μmϕ is opened was adhered on the top surface of each sidewall by use of an adhesive resulting in constitution of an inkjet recording head. Filler is not mixed into the adhesive.

Herein, density of an ink channel was 180 dpi (141 μm pitch), each ink channel having ink flow path width of 85 μm and length of 3 mm, and water-based ink (having a specific gravity of 1.06, and a bulk modulus of elasticity of 2.5 GPa) was utilized.

Total of 4 sets of inkjet recording heads (examples 1–3 and a comparison 1) were prepared with various cross-sectional areas by varying the depth of the ink channel as shown in Table 1. Each value of a ratio of compliance (Kcr), CTC, CTE and |CTC+CTE| of each recording head is shown in Table 1.

Evaluation of each recording head was performed by printing a solid image by driving each recording head for three cycles in a time-sharing mode while applying a driving pulse of 5 μsec pulse width to the electrode at a voltage of giving an ink ejection speed of 6 m/sec, and observing the degree of density decrease at the circumference of a solid image based on the following evaluation criteria. The results are shown in Table 1.

A: Uneven density was hardly observed.

B: Slightly uneven density was observed, however there was no practical problem with respect to image quality.

C: Significant uneven density was observed.

TABLE 1

| | Depth Of Ink Channel | Kcr | CTC | CTE | \|CTC + CTE\| | Image Evaluation |
|---|---|---|---|---|---|---|
| Example 1 | 200 μm | 0.43 | 2.6% | −7.2% | 4.6% | A |
| Example 2 | 250 μm | 0.68 | 6.4% | −5.6% | 0.8% | A |
| Example 3 | 300 μm | 1.03 | 14.8% | −5.1% | 9.7% | A–B |
| Comparison 1 | 350 μm | 1.51 | 31.9% | −4.0% | 27.9% | C |

Examples 4–6, and Comparison 2

The inkjet recording heads having 20 μmϕ nozzle, ink channel density of 300 dpi (85 μm pitch), ink channel having ink flow path width of 42 μm and length of 2 mm were used. With keeping other conditions same as those of Example 1–3 and Comparison 1, the depth of ink channels were varied to form ink channels with various cross sectional areas as shown in Table 2. Each value of a ratio of compliance (Kcr), CTC, CTE and |CTC+CTE| of each recording head is shown in Table 2.

Evaluation of each recording head was performed by printing a solid image with a driving pulse of 3 μsec pulse width. Other printing conditions and evaluation criteria were same as those of Example 1–3 and Comparison 1.

TABLE 2

| | Depth Of Ink Channel | Kcr | CTC | CTE | \|CTC + CTE\| | Image Evaluation |
|---|---|---|---|---|---|---|
| Example 4 | 125 μm | 0.45 | 2.8% | −7.6% | 4.8% | A |
| Example 5 | 150 μm | 0.62 | 5.3% | −6.6% | 1.3% | A |
| Example 6 | 175 μm | 0.85 | 9.9% | −6.0% | 3.9% | A |
| Comparison 2 | 200 μm | 1.13 | 17.5% | −4.8% | 12.7% | B–C |

Examples 7–9, and Comparison 3

The inkjet recording heads having 15 μmϕ nozzle, ink channel density of 360 dpi (71 μm pitch), ink channel having ink flow path width of 35 μm and length of 1.5 mm were used. With keeping other conditions same as those of Example 1–3 and Comparison 1, the depth of ink channels were varied to form ink channels with various cross sectional areas as shown in Table 3 to prepare four recording heads. Each value of a ratio of compliance (Kcr), CTC, CTE and |CTC+CTE| of each recording head is shown in Table 3.

Evaluation of each recording head was performed by printing a solid image with a driving pulse of 2 μsec pulse width. Other printing conditions and evaluation criteria were same as those of Example 1–3 and Comparison 1.

TABLE 3

| | Depth Of Ink Channel | Kcr | CTC | CTE | \|CTC + CTE\| | Image Evaluation |
|---|---|---|---|---|---|---|
| Example 7 | 100 μm | 0.44 | 2.7% | −8.1% | 5.4% | A |
| Example 8 | 125 μm | 0.65 | 5.8% | −7.3% | 1.5% | A |
| Example 9 | 150 μm | 0.93 | 11.8% | −5.9% | 5.9% | A |
| Comparison 3 | 175 μm | 1.30 | 23.2% | −4.7% | 18.5% | C |

As shown in Table 1–3, when compared with the same depth of ink channels, as the density of ink channels increases, the distance between ink channels decreases. And according to the increase of compliance ratio (Kcr), the value of crosstalk CTC increases. However, it is found out that, crosstalk can be canceled by making the depth of ink channels small.

Further, in each of Examples 1–9, a product of density and depth of ink channels satisfies the condition of not greater than $5.5\times10^4$, and the image evaluation was found to be more desirable than cases of Comparison 1–3, where this condition is not satisfied.

What is claimed is:

1. An inkjet recording head for ejecting ink, comprising:

a plurality of sidewalls, which comprise a piezoelectric material, and which form a plurality of ink channels separated by the plurality of sidewalls;

a bottom plate, which comprises a piezoelectric material, and which forms a bottom face of the plurality of ink channels; and a plurality of electrodes formed on the plurality of side walls, to which an electric voltage is applied to cause a pressure change in the plurality of ink channels by shear deformation of the plurality of sidewalls, so as to eject the ink in the plurality of ink channels;

wherein all of the plurality of ink channels are divided into at least two groups of ink channels, and each said group of ink channels comprises ink channels having at least one of the plurality of ink channels not in the group sandwiched therebetween; and wherein an ink ejection operation is performed successively in a time-sharing mode for each of the groups of ink channels, while satisfying conditions:

$$|CTC+CTE|\leqq 10\ (\%)\ \text{and}\ |CTE|\geqq 5\ (\%)$$

where CTC is a crosstalk between ink channels in one group of ink channels due to a compliance ratio of the plurality of sidewalls to the ink in the plurality of ink channels, and CTE is a crosstalk between ink channels in one group of ink channels due to a leak of an electric field caused by the electric voltage applied to the plurality of electrodes is CTE, and wherein CTC and CTE have a canceling effect on each other.

2. The inkjet recording head of claim 1, wherein each of the plurality of sidewalls comprises two layers of piezoelectric material laminated via a contact face, and each of the two layers is polarized differently in a direction perpendicular to the contact face.

3. The inkjet recording head of claim 1, wherein the plurality of electrodes have a height of at least a/2 extending from the bottom face of the plurality of ink channels, where a is an ink flow path width of each of the plurality of ink channels.

4. The inkjet recording head of claim 1, wherein the plurality of the electrodes are formed by a plating method.

5. The inkjet recording head of claim 1, wherein each of the plurality of ink channels has an ink flow path width of not greater than 100 μm, and an ink channel depth of not greater than 300 μm.

6. The inkjet recording head of claim 5, wherein the plurality of ink channels are formed by:

a substrate, on which a plurality of grooves are formed that are separated by the plurality of sidewalls; and a cover plate adhered to top faces of the plurality of sidewalls;

wherein a thickness of the piezoelectric material at the bottom face of each of the plurality of ink channels is at least 10 μm.

7. The inkjet recording head of claim 6, wherein a density of the plurality of ink channels is at least 300 dpi.

8. The inkjet recording head of claim 1, wherein the plurality of ink channels are formed by:

a substrate, on which a plurality of grooves are formed that are separated by the plurality of sidewalls; and a cover plate adhered to top faces of the plurality of sidewalls;

wherein a thickness of the piezoelectric material at the bottom face of each of the plurality of ink channels is at least 10 μm.

9. The inkjet recording head of claim 1, wherein a density of the plurality of ink channels is at least 150 dpi.

10. The inkjet recording head of claim 6, wherein a density of the plurality of ink channels is at least 150 dpi.

11. The inkjet recording head of claim 1, wherein a density of the plurality of ink channels is at least 300 dpi.

12. The inkjet recording head of claim 1, wherein all of the plurality of ink channels are divided into three of said groups of ink channels.

13. An inkjet recording head for electing ink, comprising:

a plurality of sidewalls, which comprise a piezoelectric material, and which form a plurality of ink channels separated by the plurality of sidewalls;

a bottom plate, which comprises a piezoelectric material, and which forms a bottom face of the plurality of ink channels; and a plurality of electrodes formed on the plurality of side walls, to which an electric voltage is applied to cause a pressure change in the plurality of ink channels by shear deformation of the plurality of sidewalls, so as to eject the ink in the plurality of ink channels;

wherein all of the plurality of ink channels are divided into at least two groups of ink channels, and each said group of ink channels comprises ink channels having at least one of the plurality of ink channels not in the group sandwiched therebetween;

wherein an ink election operation is performed successively in a time-sharing mode for each of the groups of ink channels, while satisfying a condition:

$$|CTC+CTE|\leqq 10\ (\%)\ \text{and}\ |CTE|\geqq 5\ (\%),$$

where CTC is a crosstalk between ink channels in one group of ink channels due to a compliance ratio of the plurality of sidewalls to the ink in the plurality of ink channels, and CTE is a crosstalk between ink channels in one group of ink channels due to a leak of an electric field caused by the electric voltage applied to the plurality of electrodes is CTE; and wherein a product of a density of the plurality of ink channels (dpi) and a depth of said plurality of ink channels (μm) is less than or equal to $5.5\times10^4$.

14. The inkjet recording head of claim 13, wherein all of the plurality of ink channels are divided into three of said groups of ink channels.

15. The inkjet recording head of claim 13, wherein each of the plurality of ink channels has an ink flow path width of not greater than 100 μm, and an ink channel depth of not greater than 300 μm.

16. The inkjet recording head of claim 13, wherein the plurality of ink channels are formed by:

a substrate, on which a plurality of grooves are formed that are separated by the plurality of sidewalls; and a cover plate adhered to top faces of the plurality of sidewalls;

wherein a thickness of the piezoelectric material at the bottom face of each of the plurality of ink channels is at least 10 μm.

* * * * *